US008849543B2

(12) United States Patent
Thompson et al.

(10) Patent No.: US 8,849,543 B2
(45) Date of Patent: Sep. 30, 2014

(54) METHOD TO OPERATE AN ELECTRONICALLY CONTROLLED INTERNAL COMBUSTION ENGINE

(75) Inventors: Marleen F. Thompson, Mount Clemens, MI (US); Tomislav Ivo Golub, Austin, TX (US)

(73) Assignee: Detroit Diesel Corporation, Detroit, MI (US)

( * ) Notice: Subject to any disclaimer, the term of this patent is extended or adjusted under 35 U.S.C. 154(b) by 491 days.

(21) Appl. No.: 13/237,195

(22) Filed: Sep. 20, 2011

(65) Prior Publication Data

US 2013/0073176 A1 Mar. 21, 2013

(51) Int. Cl.

| | |
|---|---|
| ***F02D 41/08*** | (2006.01) |
| ***F02D 41/02*** | (2006.01) |
| ***F02D 31/00*** | (2006.01) |
| ***F02D 41/14*** | (2006.01) |
| *F02D 41/10* | (2006.01) |
| *F02B 29/04* | (2006.01) |
| *F02M 25/07* | (2006.01) |

(52) U.S. Cl.

CPC .... *F02D 41/0205* (2013.01); *F02D 2200/0802* (2013.01); *F02D 41/024* (2013.01); *F02D 31/008* (2013.01); *F02B 29/0406* (2013.01); *F02M 25/0707* (2013.01); *F02M 25/0728* (2013.01); *F02D 41/08* (2013.01); *F02D 41/1459* (2013.01); *F02D 2250/36* (2013.01)

USPC ..... 701/102; 123/339.1

(58) Field of Classification Search

CPC ..... F02D 2200/0802; F02D 41/08; F02D 41/024; F02D 31/008

USPC ..... 123/339.1, 339.16, 339.22; 701/102, 701/110; 60/274, 285

See application file for complete search history.

(56) References Cited

U.S. PATENT DOCUMENTS

| | | | | |
|---|---|---|---|---|
| 5,431,042 | A | 7/1995 | Lambert et al. | |
| 5,703,777 | A | 12/1997 | Buchhop et al. | |
| 6,882,929 | B2 | 4/2005 | Liang et al. | |
| 7,073,321 | B2 * | 7/2006 | Katayama et al. | 60/284 |
| 7,212,908 | B2 | 5/2007 | Li et al. | |
| 2008/0149081 | A1 | 6/2008 | Allain | |
| 2012/0151900 | A1 * | 6/2012 | Whitt et al. | 60/274 |

* cited by examiner

*Primary Examiner* — Mahmoud Gimie

(74) *Attorney, Agent, or Firm* — Bill C. Panagos; Linda D. Kennedy; Butzel Long

(57) ABSTRACT

A method and computer readable medium are disclosed to control operation of an internal combustion engine having an electronic control unit (ECU) with memory to burn off HC in an engine exhaust system and limit hydrocarbon and NOx content in the engine exhaust stream while operating the engine in idle mode.

12 Claims, 3 Drawing Sheets

METHOD TO OPERATE AN ELECTRONICALLY CONTROLLED INTERNAL COMBUSTION ENGINE

TECHNICAL FIELD

Vehicle operators and operators of equipment with internal combustion engines are increasingly mandated to control hydrocarbon and NOx output. However, there are costs involved in the operation of an internal combustion engine to control such exhaust outputs that affect fuel economy as well as other features and functions that the engines are asked to undertake during operation. Recently, it has become desired to control hydrocarbon and NOx output in vehicles during idle operation. Many jurisdictions have mandated that the amount of time spent in engine idle cannot exceed a predetermined period of time or exceed a predetermined amount of hydrocarbon or NOx. It has been a continuing challenge to modify the operation of internal combustion engines so that they idle at a predetermined rate and period of time and do not exceed a set level of hydrocarbon or NOx in the exhaust gas and not adversely affect operator perceived performance or fuel economy.

SUMMARY

In one non-limiting embodiment, the present application relates to a method to operate an electronically controlled internal combustion engine to limit the hydrocarbon and NOx components of the exhaust gas stream without sensor input regarding the hydrocarbon or NOx content of the exhaust gas steam.

In another non-limiting embodiment, the present application further relates to a method to control the engine idle in an electronically controlled internal combustion engine to reduce hydrocarbon and NOx levels in the exhaust gas stream without sensor input regarding the hydrocarbon or NOx content of the exhaust gas steam.

In another non-limiting aspect of the present application, a method is disclosed to operate an electronically controlled internal combustion engine that limits the amount of hydrocarbons and NOx in the exhaust stream without exhaust gas sensor input. Without limiting the scope of the invention, one such method according to the present application includes determining whether the engine is in idle mode of operation. If it is determined that the engine is not in idle mode, the engine continues in a normal operation mode. If it is determined that the engine is operating in idle, then the method may include determining whether the engine has idled beyond some predetermined period of time, as determined by time values stored in memory in an electronic control unit (ECU), either in a table or in a map. If the engine has not idled beyond a predetermined period of time, the engine continues normal operation. If it is determined that the engine has idled beyond a predetermined period of time, the engine speed may be increased at a predetermined rate of increase to a predetermined maximum engine speed. The engine control unit (ECU) then determines the hydrocarbon exhaust content by reference to hydrocarbon in ppm of exhaust gas stream values stored in memory in the ECU based upon engine speed and time of idle operation. When the engine speed is increased such that the ECU determines that the values of the hydrocarbon content as stored in the ECU match the engine speed for a predetermined period of time, the method includes ramping back the engine idle when it is determined that the hydrocarbon content of the exhaust gas stream is below a predetermined level or amount. The method may be a closed loop process, as the method loops back to determining whether the engine is in idle and the process runs again.

In another embodiment, if the engine is equipped with an extended idle function to support vehicle cabin environment conditions during extended periods while the vehicle is not traveling the road, but rather is operating in a parked condition, such as, for example, Optimized Idle®, available from TAS Corporation, the method may override the Optimized Idle, increase engine speed to increase exhaust temperature and initiate HC burnoff, such as during a regeneration event, and when HC regeneration is complete, return engine operation to operation in the Optimized Idle mode.

DETAILED DESCRIPTION OF THE PREFERRED EMBODIMENT(S)

Figure 1:
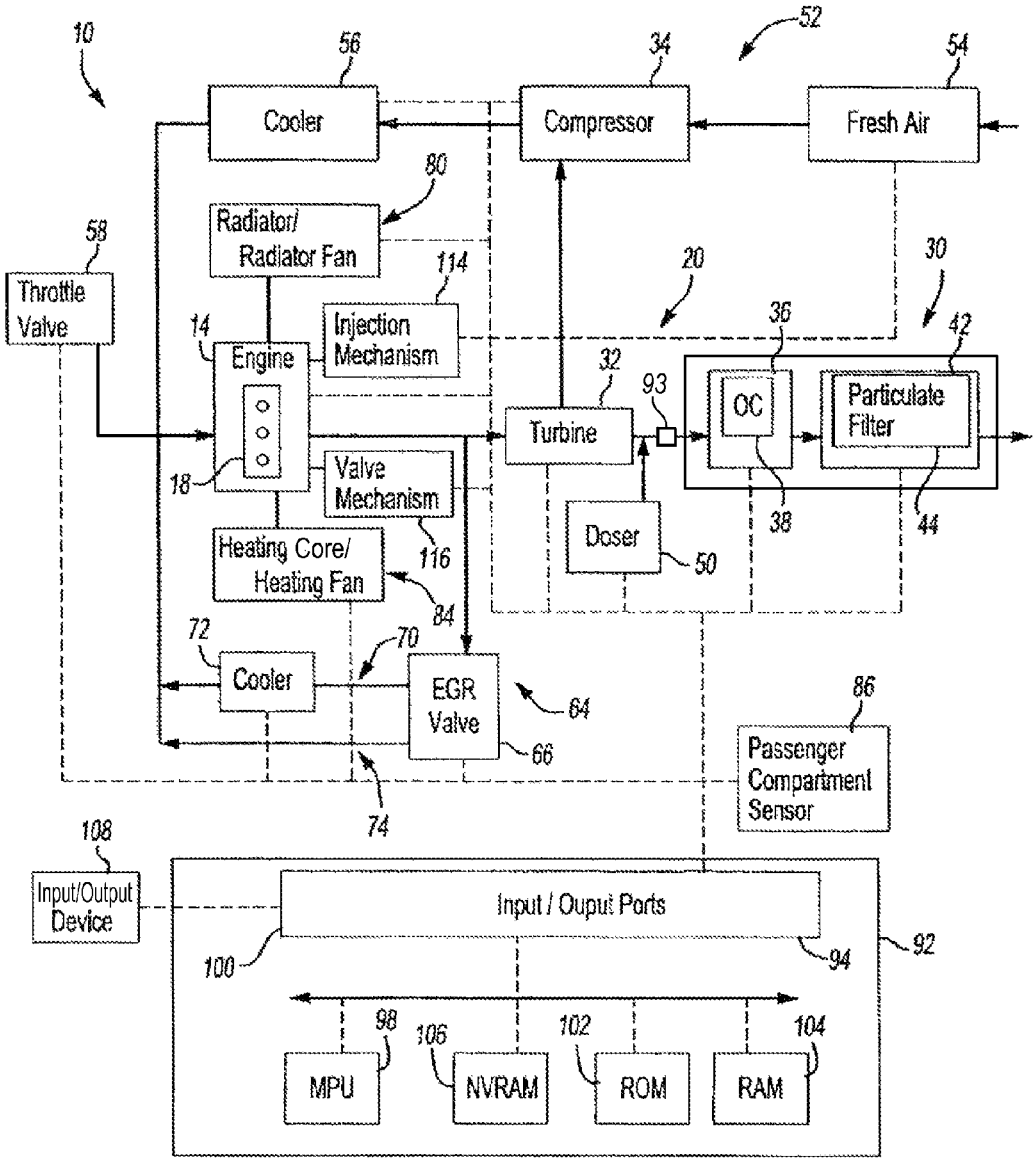
FIG. 1 is a schematic representation of an internal combustion engine with an electronic control.

FIG. 1 illustrates a vehicle powertrain system 10 in accordance with one non-limiting aspect of the present invention. The system 10 may provide power for driving any number of vehicles, including on-highway trucks, construction equipment, marine vessels, stationary generators, automobiles, trucks, tractor-trailers, boats, recreational vehicles, light and heavy-duty work vehicles, and the like.

The system 10 may be referred to as an internal combustion driven system wherein fuels, such as gasoline and diesel fuels, are burned in a combustion process to provide power, such as with a spark or compression ignition engine 14. The engine 14 may be a diesel engine that includes a number of cylinders 18 into which fuel and air are injected for ignition as one skilled in the art will appreciate. The engine 14 may be a multi-cylinder compression ignition internal combustion engine, such as a 4, 6, 8, 12, 16, or 24 cylinder diesel engines, for example. It should be noted, however, that the present invention is not limited to a particular type of engine or fuel.

Exhaust gases generated by the engine 14 during combustion may be emitted through an exhaust system 20. The exhaust system 20 may include any number of features, including an exhaust manifold and passageways to deliver the emitted exhaust gases to a particulate filter assembly 30, which in the case of diesel engines is commonly referred to as a diesel particulate filter. Optionally, the system 20 may include a turbocharger proximate the exhaust manifold for compressing fresh air delivery into the engine 14. The turbocharger, for example, may include a turbine 32 and a compressor 34, such as a variable geometry turbocharger (VGT) and/or a turbo compound power turbine. Of course, the present invention is not limited to exhaust systems having turbochargers or the like.

The particulate filter assembly 30 may be configured to capture particulates associated with the combustion process. In more detail, the particulate filter assembly 30 may include an oxidation catalyst (OC) canister 36, which in includes an OC 38, and a particulate filter canister 42, which includes a particulate filter 44. The canisters 36, 42 may be separate components joined together with a clamp or other feature such that the canisters 36, 42 may be separated for servicing and other operations. Of course, the present invention is not intended to be limited to this exemplary configuration for the particulate filter assembly 30. Rather, the present invention contemplates the particulate filter assembly including more or less of these components and features. In particular, the present invention contemplates the particulate filter assembly 30 including only the particulate filter 44 and not necessarily the OC canister 36 or substrate 38 and that the particulate filter 44 may be located in other portions of the exhaust system 20, such as upstream of the turbine 32.

The OC 38, which for diesel engines is commonly referred to as a diesel oxidation catalyst, may oxidize hydrocarbons and carbon monoxide included within the exhaust gases so as to increase temperatures at the particulate filter 44. The particulate filter 44 may capture particulates included within the exhaust gases, such as carbon, oil particles, ash, and the like, and regenerate the captured particulates if temperatures associated therewith are sufficiently high. In accordance with one non-limiting aspect of the present invention, one object of the particulate filter assembly 30 is to capture harmful carbonaceous particles included in the exhaust gases and to store these contaminates until temperatures at the particulate filter 44 favor oxidation of the captured particulates into a gas that can be discharged to the atmosphere.

The OC and particulate filter canisters 36, 42 may include inlets and outlets having defined cross-sectional areas with expansive portions there between to store the OC 38 and particulate filter 44, respectively. However, the present invention contemplates that the canisters 36, 42 and devices therein may include any number configurations and arrangements for oxidizing emissions and capturing particulates. As such, the present invention is not intended to be limited to any particular configuration for the particulate filter assembly 30.

To facilitate oxidizing the capture particulates, a doser 50 may be included to introduce fuel to the exhaust gases such that the fuel reacts with the OC 38 and combusts to increase temperatures at the particulate filter 44, such as to facilitate regeneration. For example, one non-limiting aspect of the present invention contemplates controlling the amount of fuel injected from the doser as a function of temperatures at the particulate filter 44 and other system parameters, such as air mass flow, EGR temperatures, and the like, so as to control regeneration. However, the present invention also contemplates that fuel may be included within the exhaust gases through other measures, such as by controlling the engine 14 to emit fuel with the exhaust gases.

An air intake system 52 may be included for delivering fresh air from a fresh air inlet 54 through an air passage to an intake manifold for introduction to the engine 14. In addition, the system 52 may include an air cooler or charge air cooler 56 to cool the fresh air after it is compressed by the compressor 34. Optionally, a throttle intake valve 58 may be provided to control the flow of fresh air to the engine 14. Optionally, the throttle intake valve 58 may also be provided to control the flow of EGR gases to the engine 14 or control both fresh air and EGR gases 64 to the engine 14. The throttle valve 58 may be a manually or electrically operated valve, such as one which is responsive to a pedal position of a throttle pedal operated by a driver of the vehicle. There are many variations possible for such an air intake system and the present invention is not intended to be limited to any particular arrangement. Rather, the present invention contemplates any number of features and devices for providing fresh air to the intake manifold and cylinders, including more or less of the foregoing features.

An exhaust gas recirculation (EGR) system 64 may be optionally provided to recycle exhaust gas to the engine 14 for mixture with the fresh air. The EGR system 64 may selectively introduce a metered portion of the exhaust gases into the engine 14. The EGR system 64, for example, may dilute the incoming air charge and lower peak combustion temperatures to reduce the amount of oxides of nitrogen produced during combustion. The amount of exhaust gas to be recirculated may be controlled by controlling an EGR valve 66 and/or in combination with other features, such as the turbocharger. The EGR valve 66 may be a variable flow valve that is electronically controlled. There are many possible configurations for the controllable EGR valve 66 and embodiments of the present invention are not limited to any particular structure for the EGR valve 66.

The EGR system 64 in one non-limiting aspect of the present invention may include an EGR cooler passage 70, which includes an EGR cooler 72, and an EGR cooler bypass 74. The EGR valve 66 may be provided at the exhaust manifold to meter exhaust gas through one or both of the EGR cooler passage 70 and bypass 74. Of course, the present invention contemplates that the EGR system 64 may include more or less of these features and other features for recycling exhaust gas. Accordingly, the present invention is not intended to be limited to any one EGR system and contemplates the use of other such systems, including more or less of these features, such as an EGR system having only one of the EGR cooler passage or bypass.

A cooling system 80 may be included for cycling the engine 14 by cycling coolant there through. The coolant may be sufficient for fluidly conducting away heat generated by the engine 14, such as through a radiator. The radiator may include a number of fins through which the coolant flows to be cooled by air flow through an engine housing and/or generated by a radiator fan directed thereto as one skilled in the art will appreciate. It is contemplated, however, that the present invention may include more or less of these features in the cooling system 80 and the present invention is not intended to be limited to the exemplary cooling system described above.

The cooling system 80 may operate in conjunction with a heating system 84. The heating system 84 may include a heating core, a heating fan, and a heater valve. The heating core may receive heated coolant fluid from the engine 14 through the heater valve so that the heating fan, which may be electrically controllable by occupants in a passenger area or cab of a vehicle, may blow air warmed by the heating core to the passengers. For example, the heating fan may be controllable at various speeds to control an amount of warmed air blown past the heating core whereby the warmed air may then be distributed through a venting system to the occupants. Optionally, sensors and switches 86 may be included in the passenger area to control the heating demands of the occupants. The switches and sensors may include dial or digital switches for requesting heating and sensors for determining whether the requested heating demand was met. The present invention contemplates that more or less of these features may be included in the heating system and is not intended to be limited to the exemplary heating system described above.

A controller 92, such as an electronic control module or engine control module, may be included in the system 10 to control various operations of the engine 14 and other system or subsystems associated therewith, such as the sensors in the exhaust, EGR, and intake systems. Various sensors may be in electrical communication with the controller via input/output ports 94. The controller 92 may include a microprocessor unit (MPU) 98 in communication with various computer readable storage media via a data and control bus 100. The computer readable storage media may include any of a number of known devices which function as read only memory 102, random access memory 104, and non-volatile random access memory 106. A data, diagnostics, and programming input and output device 108 may also be selectively connected to the controller via a plug to exchange various information therebetween. The device 108 may be used to change values within the computer readable storage media, such as configuration settings, calibration variables, instructions for EGR, intake, and exhaust systems control and others.

The system 10 may include an injection mechanism 114 for controlling fuel and/or air injection for the cylinders 18. The injection mechanism 114 may be controlled by the controller 92 or other controller and comprise any number of features, including features for injecting fuel and/or air into a common-rail cylinder intake and a unit that injects fuel and/or air into each cylinder individually. For example, the injection mechanism 114 may separately and independently control the fuel and/or air injected into each cylinder such that each cylinder may be separately and independently controlled to receive varying amounts of fuel and/or air or no fuel and/or air at all. Of course, the present invention contemplates that the injection mechanism 114 may include more or less of these features and is not intended to be limited to the features described above.

The system 10 may include a valve mechanism 116 for controlling valve timing of the cylinders 18, such as to control air flow into and exhaust flow out of the cylinders 18. The valve mechanism 116 may be controlled by the controller 92 or other controller and comprise any number of features, including features for selectively and independently opening and closing cylinder intake and/or exhaust valves. For example, the valve mechanism 116 may independently control the exhaust valve timing of each cylinder such that the exhaust and/or intake valves may be independently opened and closed at controllable intervals, such as with a compression brake. Of course, the present invention contemplates that the valve mechanism may include more or less of these features and is not intended to be limited to the features described above.

In operation, the controller 92 receives signals from various engine/vehicle sensors and executes control logic embedded in hardware and/or software to control the system 10. The computer readable storage media may, for example, include instructions stored thereon that are executable by the controller 92 to perform methods of controlling all features and sub-systems in the system 10. The program instructions may be executed by the controller in the MPU 98 to control the various systems and subsystems of the engine and/or vehicle through the input/output ports 94. In general, the dashed lines shown in FIG. 1 illustrate the optional sensing and control communication between the controller and the various components in the powertrain system. Furthermore, it is appreciated that any number of sensors and features may be associated with each feature in the system for monitoring and controlling the operation thereof.

In one non-limiting aspect of the present application, the controller 92 may be the DDEC controller available from Detroit Diesel Corporation, Detroit, Mich. Various other features of this controller are described in detail in a number of U.S. patents assigned to Detroit Diesel Corporation. Further, the controller may include any of a number of programming and processing techniques or strategies to control any feature in the system 10. Moreover, the embodiments of the present application contemplate that the system may include more than one controller, such as separate controllers for controlling system or sub-systems, including an exhaust system controller to control exhaust gas temperatures, mass flow rates, and other features associated therewith. In addition, these controllers may include other controllers besides the DDEC controller described above.

In accordance with one non-limiting aspect of the present application, the controller 92 or other features may be configured for permanently storing emission related fault codes in memory that is not accessible to unauthorized service tools. Authorized service tools may be given access by a password and in the event access is given, a log is made of the event as well as whether any changes that are attempted to made to the stored fault codes. It is contemplated that any number of faults may be stored in permanent memory, and that preferably eight such faults are stored in memory.

Figure 2:
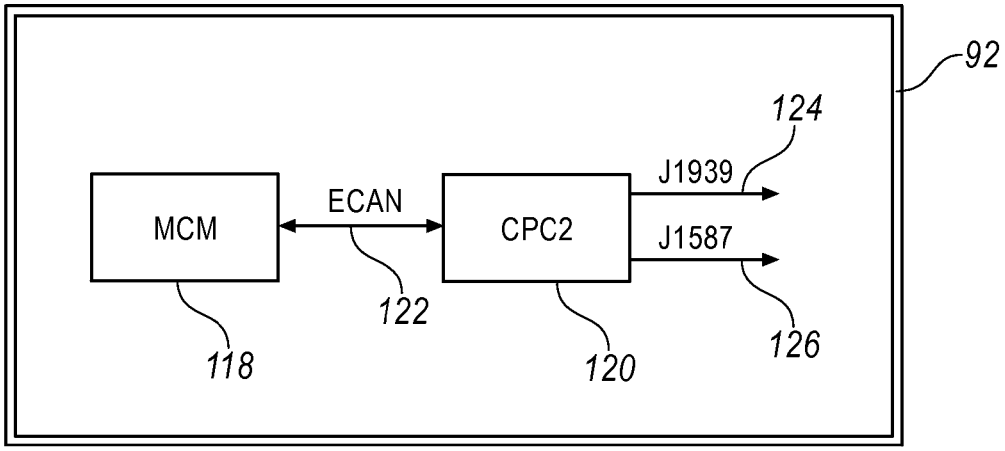
FIG. 2 is a schematic representation of one embodiment of an engine controller useful with the present application.

FIG. 2 is a schematic representation of one embodiment of the controller 92 of the present application. The controller has a Motor Control Module 118 and a Common Powertrain Controller 120. Each of the Controller and the Motor Control Module has memory for storage and retrieval of operating software and faults. The Motor Control Module and the Common Powertrain Controller communicate with each other via the electronic common area network (ECAN) 122. It is contemplated that any electronic communication between the Motor Control Module (MCM) and the Common Powertrain Controller is acceptable to communicate static faults stored in either, so that each has the most current version of the faults in the other module at any time. The Common Powertrain Controller communicates with the vehicle systems via an SAE data link J1939 and J 1587, (124 and 126, respectively) and it is contemplated that it is equally possible that the Common Powertrain Controller (CPC2) may communicate with the various systems over a UDS link.

Figure 3:
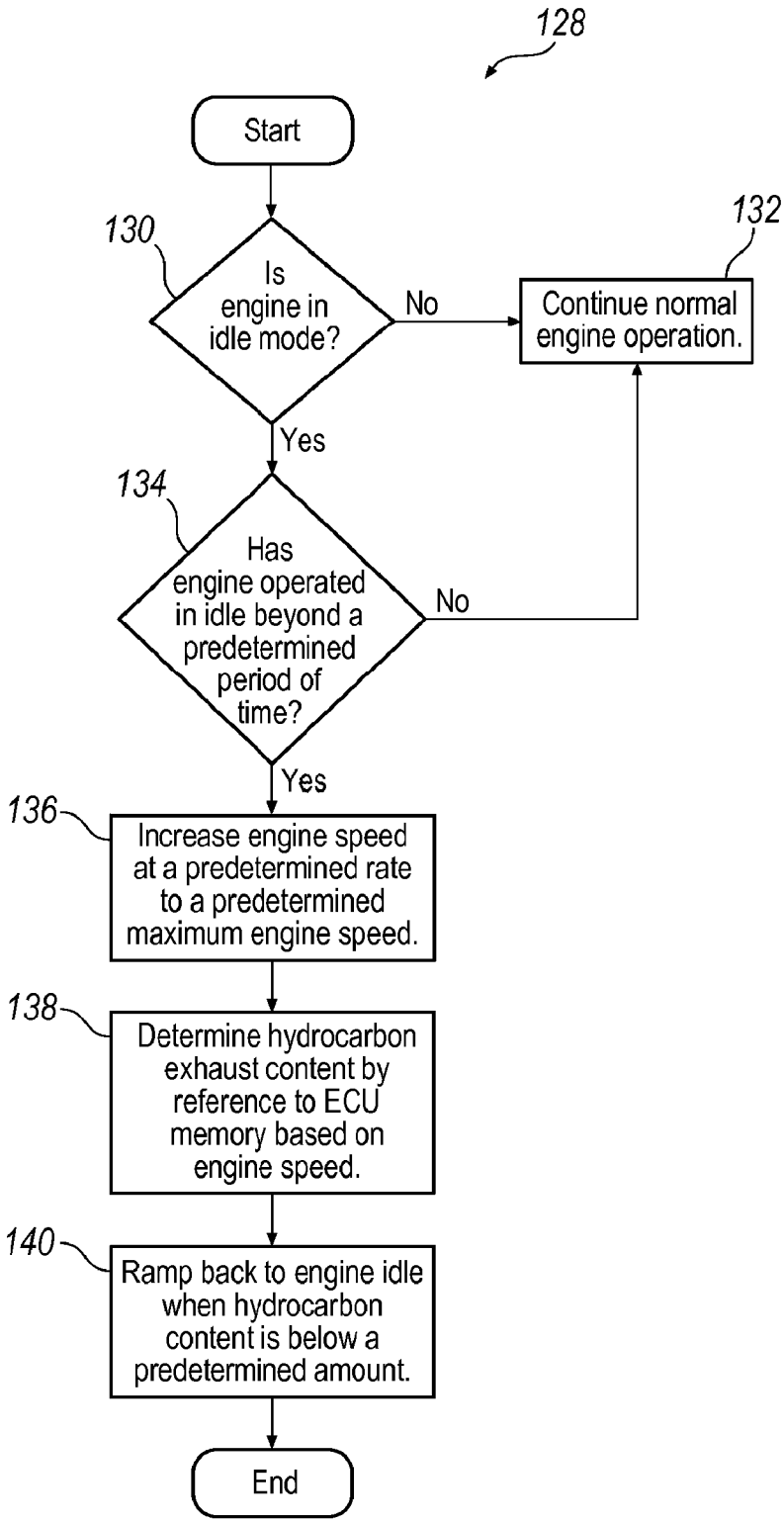
FIG. 3 is a flowchart representation of one method according to the present application.

FIG. 3 is a schematic representation showing one embodiment of the method 128 according to the present application.

Specifically, method 128 is a closed loop method to operate the electronically controlled internal combustion engine. Step 130 is determining whether the engine is operating in engine idle mode. Engine idle mode is determined usually by reference to road speed, wheel speed, transmission speed, engine speed, fueling or any other manner in which it can be determined that an engine is operating in idle mode. If it is determined that the engine is not operating in engine idle mode, the method proceeds to step 132, where normal engine operation proceeds.

When it is determined in step 130 that the engine is in idle mode, step 134 determines whether the engine has operated in idle mode beyond a predetermined period of time. The predetermined period of time is usually a value in memory in the ECU that is the amount of time the engine may run in idle before it begins to exceed the hydrocarbon (HC) and NOx levels that are also values stored in memory in the ECU. These values, may be stored in Tables or in maps. If the engine has not operated in idle beyond a predetermined period of time, the method loops back to step 132, and normal engine operation continues. In the event it is determined that the engine has operated in idle beyond a predetermined period of time, step 136 increases the engine speed at a predetermined rate to a predetermined maximum engine speed. The increase in engine speed increases the temperature in the exhaust and burns HC from the exhaust stream. The ECU then determines at step 138 the hydrocarbon exhaust content by reference to values stored in memory in the ECU, either in a map or in tables, based upon a predetermined maximum engine speed. When the hydrocarbon content in the exhaust gas stream has been determined, step 140 ramps the engine operation speed back to idle after the hydrocarbon content is determined to be below a certain level as determined by the values in the ECU memory. The method then loops back to step 130 and the method can be understood to be a closed loop method.

It is further contemplated that, if the vehicle is not traveling down a road, but is operating in an extended engine idle operation mode, such as, for example, if an Optimized Idle feature is enabled in the ECU, the method overrides the Optimized Idle feature and performs the operation as set forth above. After the regeneration event has completed, the engine operation returns to the Optimized Idle mode of operation.

While several possible embodiments have been described, it is understood that all are non-limiting and that the words used herein are words of description and not words of limitation. It is further understood that many modifications and variations may be made to the described embodiments without departing from the scope and spirit of the invention as set forth in the appended claims.

The invention claimed is:

1. A method to control operation of an internal combustion engine having an electronic control unit (ECU) with memory to limit hydrocarbon and NOx content in the engine exhaust stream while operating said engine in idle mode, comprising:

determining whether said engine is operating in idle mode;

determining whether said engine is operating in idle mode beyond a predetermined period of time;

increasing engine speed at a predetermined rate to a predetermined maximum engine speed when the engine has operated in idle mode beyond a predetermined period of time;

determining exhaust component content by reference to values stored in ECU memory based upon engine speed;

decreasing engine speed at a predetermined rate to engine idle mode when hydrocarbon content and NOx content is determined to be below a predetermined level after the engine has reached a predetermined maximum engine speed.

2. The method of claim 1, wherein determining whether said engine is operating in idle mode is made by reference to engine speed, wheel speed, transmission, road speed, engine fueling, or combinations thereof.

3. The method of claim 1, wherein if it is determined that the engine is not operating in engine idle mode, the ECU continues normal engine operation.

4. The method of claim 1, wherein the engine continues normal engine operation if it is determined that the engine has not operated in idle mode beyond a predetermined period of time.

5. The method of claim 1, wherein said method is closed loop.

6. The method of claim 1, further including overriding an extended engine idle operation mode to initiate regeneration of the exhaust system components, and returning engine operating mode to said extended engine idle operation mode.

7. A computer readable medium, comprising instructions configured for determining whether an engine is operating in idle mode;

determining whether said engine is operating in idle mode beyond a predetermined period of time;

increasing engine speed at a predetermined rate to a predetermined maximum engine speed when the engine has operated in idle mode beyond a predetermined period of time;

determining exhaust component content by reference to values stored in ECU memory based upon engine speed; and decreasing engine speed at a predetermined rate to engine idle mode when hydrocarbon content and NOx content is determined to be below a predetermined level after the engine has reached a predetermined maximum engine speed.

8. The computer readable medium of claim 7, wherein determining whether said engine is operating in idle mode is made by reference to engine speed, wheel speed, transmission, road speed, engine fueling, or combinations thereof.

9. The computer readable medium of claim 7, wherein if it is determined that the engine is not operating in engine idle mode, the ECU continues normal engine operation.

10. The computer readable medium of claim 7, wherein the engine continues normal engine operation if it is determined that the engine has not operated in idle mode beyond a predetermined period of time.

11. The computer readable medium of claim 7, wherein said instructions form a closed loop.

12. The computer readable medium of claim 7, further including overriding an extended engine idle operation mode to initiate regeneration of the exhaust system components, and returning engine operating mode to said extended engine idle operation mode.

* * * * *